US011412904B2

(12) United States Patent
Henderson

(10) Patent No.: US 11,412,904 B2
(45) Date of Patent: Aug. 16, 2022

(54) SEPARATOR CONFIGURATION

(71) Applicant: Techtronic Industries Co. Ltd., Tsuen Wan (HK)

(72) Inventor: Gregg A. Henderson, Munroe Falls, OH (US)

(73) Assignee: Techtronic Industries Co. Ltd., New Territories (HK)

( * ) Notice: Subject to any disclaimer, the term of this patent is extended or adjusted under 35 U.S.C. 154(b) by 311 days.

(21) Appl. No.: 16/846,589

(22) Filed: Apr. 13, 2020

(65) Prior Publication Data

US 2020/0237170 A1 Jul. 30, 2020

Related U.S. Application Data

(63) Continuation of application No. 14/622,141, filed on Feb. 13, 2015, now Pat. No. 10,631,697.

(60) Provisional application No. 62/037,285, filed on Aug. 14, 2014, provisional application No. 61/939,949, filed on Feb. 14, 2014.

(51) Int. Cl.
*A47L 9/16* (2006.01)

(52) U.S. Cl.
CPC ..... *A47L 9/1608* (2013.01); *A47L 9/165* (2013.01); *A47L 9/1658* (2013.01); *A47L 9/1683* (2013.01); *A47L 9/1691* (2013.01)

(58) Field of Classification Search
CPC ..... A47L 9/1608; A47L 9/165; A47L 9/1658; A47L 9/1683; A47L 9/1691
See application file for complete search history.

(56) References Cited

U.S. PATENT DOCUMENTS

| | | | |
|---|---|---|---|
| 2,657,417 | A | 11/1953 | Howard |
| 4,268,288 | A | 5/1981 | Coombs |
| 4,403,372 | A | 9/1983 | Keane et al. |
| 4,789,476 | A | 12/1988 | Schulz |
| 4,853,008 | A | 8/1989 | Dyson |
| 5,350,432 | A | 9/1994 | Lee |
| 5,779,745 | A | 7/1998 | Kilstrom |
| 5,935,279 | A | 8/1999 | Kilstrom |
| 5,950,274 | A | 9/1999 | Kilstrom |
| 6,003,196 | A | 12/1999 | Wright et al. |
| 6,129,775 | A | 10/2000 | Conrad et al. |
| 6,141,826 | A | 11/2000 | Conrad et al. |

(Continued)

FOREIGN PATENT DOCUMENTS

| | | |
|---|---|---|
| EP | 1690487 | 8/2006 |
| WO | WO2014/044541 | 4/2010 |

OTHER PUBLICATIONS

International Search Report and Written Opinion for Application No. PCT/US2015/015852 dated Jun. 26, 2015 (17 pages).

*Primary Examiner* — David Redding
(74) *Attorney, Agent, or Firm* — Michael Best & Friedrich LLP

(57) ABSTRACT

A vacuum cleaner operable to separate debris from an airflow including a separator defining a cyclonic chamber having a dirty air inlet, a dirt outlet, and an air outlet. The vacuum cleaner further includes a dirt collection chamber in fluid communication with the dirt outlet of the cyclonic chamber. The dirt collection chamber further includes a sidewall having an opening, and the separator is pivotably coupled to the dirt collection chamber. The separator is received within the dirt collection chamber by pivoting the separator into the opening.

20 Claims, 11 Drawing Sheets

(56) References Cited

U.S. PATENT DOCUMENTS 6,168,641 B1 1/2001 Tuvin et al.
6,168,716 B1 1/2001 Conrad et al.
6,173,474 B1 1/2001 Conrad
6,195,835 B1 3/2001 Song et al.
6,221,134 B1 4/2001 Conrad et al.
6,228,151 B1 5/2001 Conrad et al.
6,228,260 B1 5/2001 Conrad et al.
6,231,645 B1 5/2001 Conrad et al.
6,251,296 B1 6/2001 Conrad et al.
6,277,278 B1 8/2001 Conrad et al.
6,306,199 B1 10/2001 Gustafson et al.
6,312,594 B1 11/2001 Conrad et al.
6,334,234 B1 1/2002 Conrad et al.
6,344,064 B1 2/2002 Conrad
6,350,292 B1 2/2002 Lee et al.
6,391,095 B1 5/2002 Conrad et al.
6,398,834 B2 6/2002 Oh
6,406,505 B1 6/2002 Oh et al.
6,419,719 B2 7/2002 Conrad et al.
6,432,154 B2 8/2002 Oh et al.
6,440,197 B1 8/2002 Conrad et al.
6,482,246 B1 11/2002 Dyson et al.
6,485,536 B1 11/2002 Masters
6,502,277 B1 1/2003 Petersson et al.
6,502,278 B2 1/2003 Oh et al.
6,519,804 B1 2/2003 Vujik
6,532,620 B2 3/2003 Oh
6,533,834 B2 3/2003 Conrad et al.
6,536,073 B2 3/2003 Uratani et al.
6,546,593 B2 4/2003 Oh et al.
6,553,612 B1 4/2003 Dyson et al.
6,558,453 B2 5/2003 Sepke et al.
6,562,093 B2 5/2003 Oh
6,572,668 B1 6/2003 An et al.
6,578,230 B2 6/2003 Park et al.
6,579,334 B2 6/2003 Oh et al.
6,582,489 B2 6/2003 Conrad
6,588,051 B2 7/2003 Hashizume et al.
6,589,309 B2 7/2003 Oh et al.
6,596,045 B2 7/2003 Qian
6,596,046 B2 7/2003 Conrad et al.
6,596,047 B2 7/2003 Oh
6,599,338 B2 7/2003 Oh et al.
6,599,339 B2 7/2003 Oh
6,599,340 B2 7/2003 Conrad et al.
6,607,572 B2 8/2003 Gammack et al.
6,607,575 B2 8/2003 Oh et al.
6,613,116 B2 9/2003 Oh
6,613,129 B2 9/2003 Gen
6,616,721 B2 9/2003 Oh
6,623,539 B2 9/2003 Lee et al.
6,625,845 B2 9/2003 Matsumoto et al.
6,640,385 B2 11/2003 Oh et al.
6,648,934 B2 11/2003 Choi et al.
6,660,053 B2 12/2003 Oh et al.
6,662,403 B2 12/2003 Oh
6,679,930 B1 1/2004 An et al.
6,702,868 B2 3/2004 Oh et al.
6,706,095 B2 3/2004 Morgan
6,709,495 B1 3/2004 Storer
6,712,868 B2 3/2004 Murphy et al.
6,732,405 B2 5/2004 Oh
6,732,406 B2 5/2004 Oh
6,735,816 B2 5/2004 Oh et al.
6,736,873 B2 5/2004 Conrad et al.
6,746,500 B1 6/2004 Park et al.
6,757,933 B2 7/2004 Oh et al.
6,766,557 B2 7/2004 Park et al.
6,766,558 B1 7/2004 Matsumoto et al.
6,782,583 B2 8/2004 Oh
6,782,585 B1 8/2004 Conrad et al.
6,810,557 B2 11/2004 Hansen et al.
6,810,558 B2 11/2004 Lee
6,811,584 B2 11/2004 Oh
6,818,033 B2 11/2004 North
6,818,036 B1 11/2004 Seaman
6,824,580 B2 11/2004 Oh
6,833,015 B2 12/2004 Oh et al.
6,835,222 B2 12/2004 Gammack
6,840,972 B1 1/2005 Kim
6,857,165 B2 2/2005 Oh
6,868,578 B1 3/2005 Kasper et al.
6,874,197 B1 4/2005 Conrad et al.
6,896,711 B2 5/2005 Oh
6,901,626 B2 6/2005 Bair et al.
6,902,596 B2 6/2005 Conrad et al.
6,916,351 B2 7/2005 Oh
6,925,680 B2 8/2005 Oh
6,928,692 B2 8/2005 Oh et al.
6,934,994 B2 8/2005 Oh et al.
6,948,212 B2 9/2005 Oh et al.
6,951,045 B2 10/2005 Thur et al.
6,968,596 B2 11/2005 Oh et al.
6,974,488 B2 12/2005 Dyson
6,977,003 B2 12/2005 Lim et al.
6,989,039 B2 1/2006 Vujik
6,991,666 B2 1/2006 Organ
6,994,740 B2 2/2006 Gammack et al.
7,014,671 B2 3/2006 Oh
7,022,154 B2 4/2006 Oh
7,065,826 B1 6/2006 Arnold
7,074,248 B2 7/2006 Jin et al.
7,086,119 B2 8/2006 Go et al.
7,097,680 B2 8/2006 Oh
7,105,034 B2 9/2006 Jung et al.
7,105,035 B2 9/2006 Oh et al.
7,114,216 B2 10/2006 Stephens et al.
7,128,770 B2 10/2006 Oh et al.
7,140,068 B1 11/2006 Vander Baan et al.
7,152,276 B2 12/2006 Jin et al.
7,152,277 B2 12/2006 Jung et al.
7,160,346 B2 1/2007 Park
7,162,770 B2 1/2007 Davidshofer
7,163,568 B2 1/2007 Sepke et al.
7,169,201 B2 1/2007 Oh et al.
7,171,725 B2 2/2007 Sjoberg et al.
7,188,388 B2 3/2007 Best et al.
7,210,192 B2 5/2007 Ito et al.
7,228,592 B2 6/2007 Hawkins et al.
7,247,181 B2 7/2007 Hansen et al.
7,261,754 B2 8/2007 Oh et al.
7,273,506 B2 9/2007 Oh et al.
7,276,099 B2 10/2007 Hayashi et al.
7,288,129 B2 10/2007 Oh et al.
7,291,190 B2 11/2007 Dummelow
7,291,193 B2 11/2007 Oh et al.
7,293,326 B2 11/2007 Hawkins et al.
7,294,159 B2 11/2007 Oh et al.
7,297,172 B2 11/2007 Lee
7,309,368 B2 12/2007 Oh et al.
7,326,268 B2 2/2008 Oh et al.
7,329,295 B2 2/2008 Greene et al.
7,331,084 B2 2/2008 Oh
7,332,008 B2 2/2008 Oh et al.
7,334,290 B2 2/2008 Hawkins et al.
7,335,241 B2 2/2008 Oh et al.
7,335,242 B2 2/2008 Oh
7,341,611 B2 3/2008 Greene et al.
7,343,643 B2 3/2008 Kondo
7,354,468 B2 4/2008 Arnold et al.
7,361,200 B2 4/2008 Oh et al.
7,377,007 B2 5/2008 Best
7,377,953 B2 5/2008 Oh
7,381,233 B2 6/2008 Oh et al.
7,381,234 B2 6/2008 Oh
7,381,236 B2 6/2008 Lee et al.
7,381,247 B2 6/2008 Han et al.
7,381,248 B2 6/2008 Kim et al.
7,395,579 B2 7/2008 Oh
7,398,578 B2 7/2008 Lee
7,404,231 B2 7/2008 Kang
7,407,524 B2 8/2008 Han et al.
7,409,744 B2 8/2008 Go et al.
7,410,517 B2 8/2008 Han et al.

(56) References Cited

U.S. PATENT DOCUMENTS 7,410,535 B2 8/2008 Song et al.
7,416,575 B2 8/2008 Oh et al.
7,419,521 B2 9/2008 Oh et al.
7,419,522 B2 9/2008 Arnold
7,419,523 B2 9/2008 Sjöberg et al.
7,422,614 B2 9/2008 Sepke et al.
7,422,615 B2 9/2008 Kim
7,429,284 B2 9/2008 Oh et al.
7,438,737 B2 10/2008 Song et al.
7,448,146 B2 11/2008 Cho et al.
7,449,039 B2 11/2008 Hong et al.
7,449,040 B2 11/2008 Conrad et al.
7,455,708 B2 11/2008 Conrad et al.
7,462,212 B2 12/2008 Han et al.
7,470,299 B2 12/2008 Han et al.
7,473,289 B2 1/2009 Oh et al.
7,475,449 B2 1/2009 Lee
7,479,172 B2 1/2009 Ivarsson
7,479,173 B2 1/2009 Ivarsson et al.
7,481,860 B2 1/2009 Ivarsson
7,485,164 B2 2/2009 Jeong et al.
7,491,255 B2 2/2009 Jung
7,494,523 B2 2/2009 Oh et al.
7,497,899 B2 3/2009 Han et al.
7,501,002 B2 3/2009 Han et al.
7,513,924 B2 4/2009 French et al.
7,534,279 B2 5/2009 Oh et al.
7,537,625 B2 5/2009 Han et al.
7,544,224 B2 6/2009 Tanner et al.
7,544,226 B2 6/2009 Oh
7,547,336 B2 6/2009 Fester et al.
7,547,337 B2 6/2009 Oh et al.
7,547,338 B2 6/2009 Kim et al.
7,547,351 B2 6/2009 Oh et al.
7,555,808 B2 7/2009 Oh et al.
7,556,661 B2 7/2009 Jeong et al.
7,556,662 B2 7/2009 Lee et al.
7,559,963 B2 7/2009 Oh et al.
7,559,964 B2 7/2009 Oh et al.
7,559,965 B2 7/2009 Oh et al.
7,563,296 B2 7/2009 Ni
7,563,297 B2 7/2009 Kim
7,563,298 B2 7/2009 Oh
7,565,853 B2 7/2009 Arnold et al.
7,582,128 B2 9/2009 Hwang et al.
7,582,129 B2 9/2009 Kim et al.
7,594,943 B2 9/2009 Oh et al.
7,594,944 B2 9/2009 Oh
7,594,945 B2 9/2009 Kim et al.
7,597,730 B2 10/2009 Yoo et al.
7,604,674 B2 10/2009 Han et al.
7,604,675 B2 10/2009 Makarov et al.
7,611,558 B2 11/2009 Oh et al.
7,615,089 B2 11/2009 Oh
7,618,470 B2 11/2009 Eddington et al.
7,628,831 B2 12/2009 Gomiciaga-Pereda et al.
7,628,832 B2 12/2009 Sepke et al.
7,628,833 B2 12/2009 Oh
7,632,324 B2 12/2009 Makarov et al.
7,632,327 B2 12/2009 Yoo
7,635,400 B2 12/2009 Yoo
7,637,973 B2 12/2009 Oh et al.
7,637,991 B2 12/2009 Eddington et al.
7,645,311 B2 1/2010 Oh et al.
7,651,544 B1 1/2010 Fester et al.
7,662,201 B2 2/2010 Lee
7,662,202 B2 2/2010 Oh et al.
7,678,166 B2 3/2010 Yoo et al.
7,682,412 B2 3/2010 Oh
7,686,858 B2 3/2010 Oh
7,686,861 B2 3/2010 Oh
7,691,161 B2 4/2010 Oh et al.
7,704,290 B2 4/2010 Oh
7,708,789 B2 5/2010 Fester
7,708,791 B2 5/2010 Oh et al.
7,708,808 B1 5/2010 Heumann
7,717,973 B2 5/2010 Oh et al.
7,722,693 B2 5/2010 Yoo et al.
7,731,770 B2 6/2010 Strutt et al.
7,740,675 B2 6/2010 Conrad
7,743,461 B2 6/2010 Carr et al.
7,744,667 B2 6/2010 Oh et al.
7,744,668 B2 6/2010 Oh et al.
7,748,079 B2 7/2010 McDowell et al.
7,749,293 B2 7/2010 Conrad
7,749,296 B2 7/2010 Han et al.
7,763,090 B2 7/2010 Gomiciaga-Pereda et al.
7,770,256 B1 8/2010 Fester
7,771,499 B2 8/2010 Oh et al.
7,776,115 B2 8/2010 Oh et al.
7,776,116 B2 8/2010 Oh et al.
7,776,120 B2 8/2010 Conrad
7,776,121 B2 8/2010 Yun et al.
7,780,752 B2 8/2010 Cha et al.
7,785,381 B2 8/2010 Oh et al.
7,785,383 B2 8/2010 Oh et al.
7,789,922 B1 9/2010 Wai
7,789,923 B2 9/2010 Oh et al.
7,794,515 B2 9/2010 Oh et al.
7,803,205 B2 9/2010 Oh et al.
7,803,207 B2 9/2010 Conrad
7,806,950 B2 10/2010 Han et al.
7,811,345 B2 10/2010 Conrad
7,811,349 B2 10/2010 Nguyen
7,819,933 B2 10/2010 Moon et al.
7,828,866 B2 11/2010 Courtney et al.
7,841,477 B2 11/2010 Hansen
7,854,779 B2 12/2010 Oh
7,854,782 B2 12/2010 Oh et al.
7,862,637 B2 1/2011 Han et al.
7,867,306 B2 1/2011 Courtney et al.
7,867,307 B2 1/2011 Bates et al.
7,867,308 B2 1/2011 Conrad
7,874,040 B2 1/2011 Follows et al.
7,879,120 B2 2/2011 Seo et al.
7,879,121 B2 2/2011 Oh
7,879,142 B2 2/2011 Han et al.
7,882,592 B2 2/2011 Hwang et al.
7,882,593 B2 2/2011 Beskow et al.
7,887,612 B2 2/2011 Conrad
7,887,613 B2 2/2011 Ruben
7,907,680 B2 3/2011 Tsai et al.
7,908,706 B2 3/2011 Hawkins et al.
7,914,609 B2 3/2011 Sullivan et al.
7,918,909 B2 4/2011 McDowell
7,922,794 B2 4/2011 Morphey
7,931,717 B2 4/2011 Conrad
7,931,722 B2 4/2011 Sepke et al.
7,938,872 B2 5/2011 Blossey et al.
7,941,895 B2 5/2011 Conrad
7,951,216 B2 5/2011 Ha et al.
7,951,218 B2 5/2011 Oh
7,966,692 B2 6/2011 Kim
7,967,884 B2 6/2011 Sepke et al.
7,981,181 B2 7/2011 Yoo
7,992,252 B2 8/2011 Park et al.
7,996,956 B2 8/2011 Wood et al.
7,996,957 B2 8/2011 Kah, Jr.
7,998,260 B2 8/2011 Ni
8,015,659 B2 9/2011 Conrad et al.
8,020,707 B2 9/2011 Kim et al.
8,021,453 B2 9/2011 Howes
8,034,140 B2 10/2011 Conrad
8,048,180 B2 11/2011 Oh et al.
8,048,183 B2 11/2011 Conrad
8,062,398 B2 11/2011 Luo et al.
8,097,057 B2 1/2012 Arnold
8,100,999 B2 1/2012 Ashbee et al.
8,146,201 B2 4/2012 Conrad
8,151,407 B2 4/2012 Conrad
8,152,877 B2 4/2012 Greene
8,152,878 B2 4/2012 McLeod
8,152,883 B2 4/2012 Lee
8,161,597 B2 4/2012 Witter et al.

(56) References Cited

U.S. PATENT DOCUMENTS 8,161,599 B2 4/2012 Griffith et al.
8,167,964 B2 5/2012 Wai
8,176,597 B2 5/2012 Stein et al.
8,182,563 B2 5/2012 Horne et al.
8,186,006 B2 5/2012 Hyun et al.
8,192,515 B2 6/2012 Conrad
8,209,815 B2 7/2012 Makarov et al.
8,250,702 B2 8/2012 Conrad
8,252,096 B2 8/2012 Horne
8,268,029 B2 9/2012 Yoo
8,282,697 B2 10/2012 Oh
8,292,979 B2 10/2012 Conrad
8,302,252 B2 11/2012 Hyun et al.
8,302,253 B2 11/2012 Ni
8,316,507 B2 11/2012 Hyun et al.
8,348,605 B2 1/2013 de Broqueville
8,349,428 B2 1/2013 Conrad
8,361,179 B2 1/2013 Guerry et al.
8,375,509 B2 2/2013 Bates et al.
8,409,335 B2 4/2013 Dyson et al.
8,419,835 B2 4/2013 Krishnamurthy et al.
8,425,642 B2 4/2013 Worker et al.
8,448,291 B2 5/2013 Conrad
8,448,292 B2 5/2013 Miefalk et al.
8,479,358 B2 7/2013 Conrad
8,484,799 B2 7/2013 Conrad
8,486,170 B2 7/2013 Conrad et al.
8,495,789 B2 7/2013 Nicolaou et al.
8,499,411 B2 8/2013 Tran et al.
8,510,907 B2 8/2013 Conrad
8,528,160 B2 9/2013 Conrad
8,528,163 B2 9/2013 Park et al.
8,528,164 B2 9/2013 Conrad
8,533,903 B2 9/2013 Muhlenkamp et al.
8,533,904 B2 9/2013 Conrad
8,561,257 B2 10/2013 Conrad
8,562,705 B2 10/2013 Courtney et al.
8,567,005 B2 10/2013 Conrad
8,567,006 B2 10/2013 Conrad
8,567,008 B2 10/2013 Conrad
8,568,500 B2 10/2013 Han et al.
8,572,789 B2 11/2013 Horne
8,578,550 B2 11/2013 Conrad
8,578,553 B2 11/2013 Conrad
8,578,555 B2 11/2013 Conrad
8,590,102 B2 11/2013 Conrad
8,601,641 B2 12/2013 Conrad
8,607,406 B2 12/2013 Miefalk et al.
8,607,407 B2 12/2013 Conrad
8,613,125 B2 12/2013 Jeong et al.
8,621,709 B2 1/2014 Conrad
8,631,538 B2 1/2014 Huffman
8,640,303 B2 2/2014 Conrad
8,640,304 B2 2/2014 Conrad
8,646,146 B2 2/2014 Conrad
8,646,147 B2 2/2014 Conrad
8,646,148 B2 2/2014 Sunderland et al.
8,646,149 B2 2/2014 Conrad
8,646,849 B2 2/2014 Crawford et al.
8,657,903 B2 2/2014 Menssen
8,659,184 B2 2/2014 Conrad
8,661,607 B2 3/2014 Hwang et al.
8,661,611 B2 3/2014 Oh
8,667,640 B2 3/2014 Conrad
8,677,554 B2 3/2014 Conrad
8,677,558 B2 3/2014 Conrad
8,683,644 B2 4/2014 Conrad
8,689,395 B2 4/2014 Conrad
8,689,401 B2 4/2014 Makarov et al.
8,695,157 B2 4/2014 Beskow et al.
8,713,751 B2 5/2014 Conrad
8,713,754 B2 5/2014 Conrad
8,739,357 B2 6/2014 Conrad
8,739,359 B2 6/2014 Conrad
8,752,239 B2 6/2014 Conrad
8,763,202 B2 7/2014 Conrad
8,769,767 B2 7/2014 Conrad
8,776,309 B2 7/2014 Conrad
2002/0011050 A1 1/2002 Hansen et al.
2002/0134059 A1 9/2002 Oh
2003/0159235 A1 8/2003 Oh
2003/0159411 A1 8/2003 Hansen et al.
2003/0200734 A1 10/2003 Conrad
2004/0098827 A1 5/2004 Oh
2004/0098828 A1 5/2004 Oh
2004/0107530 A1 6/2004 Lee
2004/0163206 A1 8/2004 Oh
2004/0194250 A1 10/2004 Conrad et al.
2004/0231093 A1 11/2004 Oh
2005/0066469 A1 3/2005 Oh et al.
2005/0125940 A1 6/2005 McDowell
2005/0177974 A1 8/2005 Conrad et al.
2005/0198769 A1 9/2005 Lee et al.
2005/0262658 A1 12/2005 Conrad et al.
2006/0075727 A1 4/2006 Kim et al.
2006/0101611 A1* 5/2006 Oh ..... A47L 9/1691 15/353
2006/0102005 A1 5/2006 Oh
2006/0117721 A1 6/2006 Lee
2006/0117723 A1 6/2006 Yoo
2006/0130265 A1 6/2006 Oh et al.
2006/0130447 A1 6/2006 Seo et al.
2006/0130448 A1 6/2006 Han et al.
2006/0130449 A1 6/2006 Han
2006/0137310 A1 6/2006 Conrad et al.
2006/0230722 A1 10/2006 Oh et al.
2006/0254226 A1 11/2006 Jeon
2006/0272299 A1 12/2006 Choi
2006/0288671 A1 12/2006 Oh et al.
2007/0039292 A1 2/2007 Oh
2007/0079584 A1 4/2007 Kim
2007/0079586 A1 4/2007 Kim
2007/0079590 A1 4/2007 Yoo
2007/0084159 A1 4/2007 Oh et al.
2007/0084160 A1 4/2007 Kim
2007/0119129 A1 5/2007 Jeon
2007/0144116 A1 6/2007 Hong et al.
2007/0175185 A1 8/2007 Kim et al.
2007/0209334 A1 9/2007 Conrad
2007/0214754 A1 9/2007 Kim
2007/0234687 A1 10/2007 Ni
2007/0234691 A1 10/2007 Han et al.
2008/0196194 A1 8/2008 Conrad
2008/0263813 A1 10/2008 Han et al.
2008/0263815 A1 10/2008 Oh
2008/0264014 A1 10/2008 Oh et al.
2008/0289139 A1 11/2008 Makarov et al.
2008/0289140 A1 11/2008 Courtney et al.
2008/0289306 A1 11/2008 Han et al.
2009/0144932 A1 6/2009 Yoo
2009/0193613 A1 8/2009 Ruben et al.
2009/0205161 A1 8/2009 Conrad
2009/0229071 A1 9/2009 Fester et al.
2009/0229074 A1 9/2009 Oh
2009/0235482 A1 9/2009 Tanner et al.
2009/0300871 A1 12/2009 Seo et al.
2009/0313958 A1 12/2009 Gomiciaga-Pereda et al.
2010/0043170 A1 2/2010 Ni
2010/0115727 A1 5/2010 Oh
2010/0162517 A1 7/2010 Han et al.
2010/0175217 A1 7/2010 Conrad
2010/0192776 A1 8/2010 Oh et al.
2010/0223752 A1 9/2010 Conrad
2010/0229323 A1 9/2010 Conrad
2010/0229325 A1 9/2010 Conrad
2010/0229330 A1 9/2010 Park et al.
2010/0229334 A1 9/2010 Conrad
2010/0251506 A1 10/2010 Conrad
2010/0269289 A1 10/2010 Ruben
2010/0299865 A1 12/2010 Conrad
2010/0299866 A1 12/2010 Conrad
2011/0146024 A1 6/2011 Conrad
2011/0214247 A1 9/2011 Stephens et al.
2011/0219576 A1 9/2011 Conrad

(56) References Cited

U.S. PATENT DOCUMENTS

| | | | |
|---|---|---|---|
| 2011/0240526 | A1 | 10/2011 | Tammera et al. |
| 2011/0289720 | A1 | 12/2011 | Han et al. |
| 2011/0296648 | A1 | 12/2011 | Kah, Jr. |
| 2011/0314631 | A1 | 12/2011 | Conrad |
| 2012/0047682 | A1 | 3/2012 | Makarov et al. |
| 2012/0117753 | A1 | 5/2012 | Kim et al. |
| 2012/0216368 | A1 | 8/2012 | Maeda et al. |
| 2012/0222232 | A1 | 9/2012 | Conrad |
| 2012/0222238 | A1 | 9/2012 | Conrad |
| 2012/0222240 | A1 | 9/2012 | Conrad |
| 2012/0222243 | A1 | 9/2012 | Conrad |
| 2012/0222247 | A1 | 9/2012 | Conrad |
| 2012/0222248 | A1 | 9/2012 | Conrad |
| 2012/0222252 | A1 | 9/2012 | Conrad |
| 2012/0222253 | A1 | 9/2012 | Conrad |
| 2012/0222255 | A1 | 9/2012 | Conrad |
| 2012/0222257 | A1 | 9/2012 | Conrad |
| 2012/0222258 | A1 | 9/2012 | Conrad |
| 2012/0222262 | A1 | 9/2012 | Conrad |
| 2012/0311814 | A1 | 12/2012 | Kah, Jr. |
| 2013/0008140 | A1 | 1/2013 | Pike et al. |
| 2013/0091815 | A1 | 4/2013 | Smith |
| 2013/0145575 | A1 | 6/2013 | Conrad |
| 2013/0185893 | A1 | 7/2013 | Conrad |
| 2014/0013538 | A1 | 1/2014 | Dyson et al. |
| 2014/0020203 | A1 | 1/2014 | Miefalk et al. |
| 2014/0026356 | A1 | 1/2014 | Miefalk et al. |
| 2014/0053367 | A1 | 2/2014 | Conrad |
| 2014/0059797 | A1 | 3/2014 | Kim et al. |
| 2014/0059799 | A1 | 3/2014 | Kim et al. |

* cited by examiner

SEPARATOR CONFIGURATION

CROSS-REFERENCE TO RELATED APPLICATIONS

This application is a continuation of U.S. patent application Ser. No. 14/622,141, filed Feb. 13, 2015, which issued as U.S. Pat. No. 10,631,697 on Apr. 28, 2020, which claims priority to U.S. Provisional Patent Application No. 61/939,949, filed Feb. 14, 2014 and to U.S. Provisional Patent Application No. 62/037,285, filed Aug. 14, 2014, the entire contents all of which are hereby incorporated by reference herein.

BACKGROUND

The present invention relates to vacuum cleaners, and more particularly to debris separators for vacuum cleaners.

SUMMARY

In one embodiment, the invention provides a vacuum cleaner operable to separate debris from an airflow including a separator defining a cyclonic chamber having a dirty air inlet, a dirt outlet, and an air outlet. The vacuum cleaner further includes a dirt collection chamber in fluid communication with the dirt outlet of the cyclonic chamber. The dirt collection chamber further includes a sidewall having an opening. The separator is slidably received within the dirt collection chamber by inserting the separator into the opening.

In another embodiment the invention provides a vacuum cleaner operable to separate debris from an airflow including a separator defining a cyclonic chamber having a longitudinal axis, a dirty air inlet, a dirt outlet, and an air outlet. The vacuum cleaner further includes a dirt collection chamber in fluid communication with the dirt outlet of the cyclonic chamber. The separator is removably received within the dirt collection chamber along a generally horizontal direction, and the longitudinal axis of the cyclonic chamber is oriented generally horizontally when the separator is received within the dirt collection chamber.

In another embodiment the invention provides a vacuum cleaner operable to separate debris from an airflow including a separator defining a cyclonic chamber having a dirty air inlet, a dirt outlet, and an air outlet. The vacuum cleaner further includes a dirt collection chamber in fluid communication with the dirt outlet of the cyclonic chamber. The dirt collection chamber further includes a sidewall having an opening, and the separator is pivotably coupled to the dirt collection chamber. The separator is received within the dirt collection chamber by pivoting the separator into the opening.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
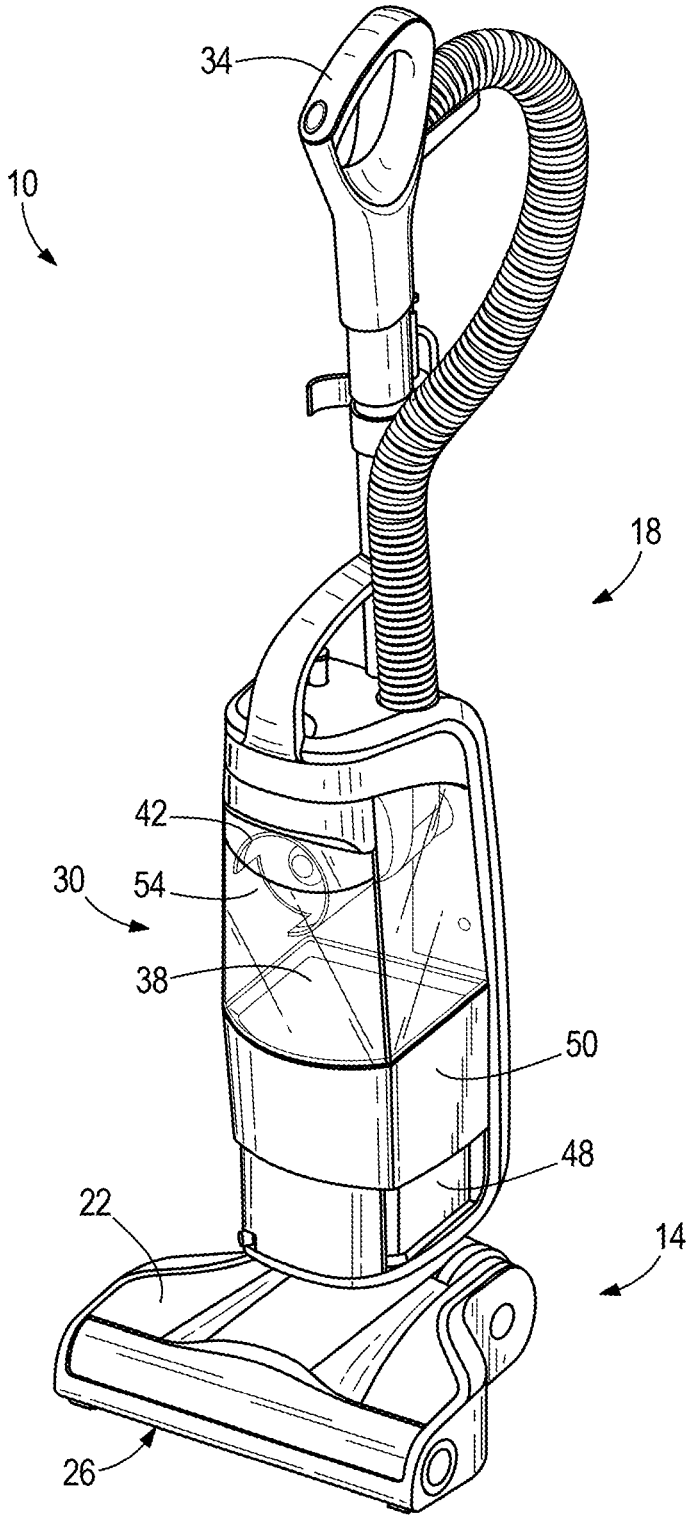
FIG. 1 is a perspective view of a vacuum cleaner according to one aspect of the invention.

FIG. 1 illustrates a vacuum cleaner 10. The illustrated vacuum cleaner 10 includes a base 14 and an upper section 18 that is pivotally coupled to the base 14 and configured to move the base 14 along a surface to be cleaned. In the illustrated embodiment, the vacuum cleaner 10 is an upright vacuum cleaner. In other embodiments, the vacuum cleaner can be other types of vacuum cleaners, such as a canister vacuum, a hand held vacuum, etc. The base 14 includes a nozzle 22 that defines an inlet 26 of the vacuum cleaner. The upper section 18 of the vacuum cleaner includes a handle 34 and a canister assembly 30 is removably coupled to the upper section 18. The canister assembly 30 defines a dirt collection chamber 38 and a separator 42. In the illustrated embodiment, the separator 42 is a cylindrical cyclonic separator with a cutout in the sidewall for the discharge of debris wherein the longitudinal axis of the cyclonic chamber is oriented generally horizontally when the separator is received within the dirt collection chamber. In other embodiments, other types of cyclonic separators can be used. The separator in various embodiments discussed below is removably received within the dirt collection chamber along a generally horizontal direction. Alternatively or additionally, the separator is slidably or pivotably received within the dirt collection chamber by inserting or pivoting the separator into an opening in the dirt collection chamber.

Figure 2:
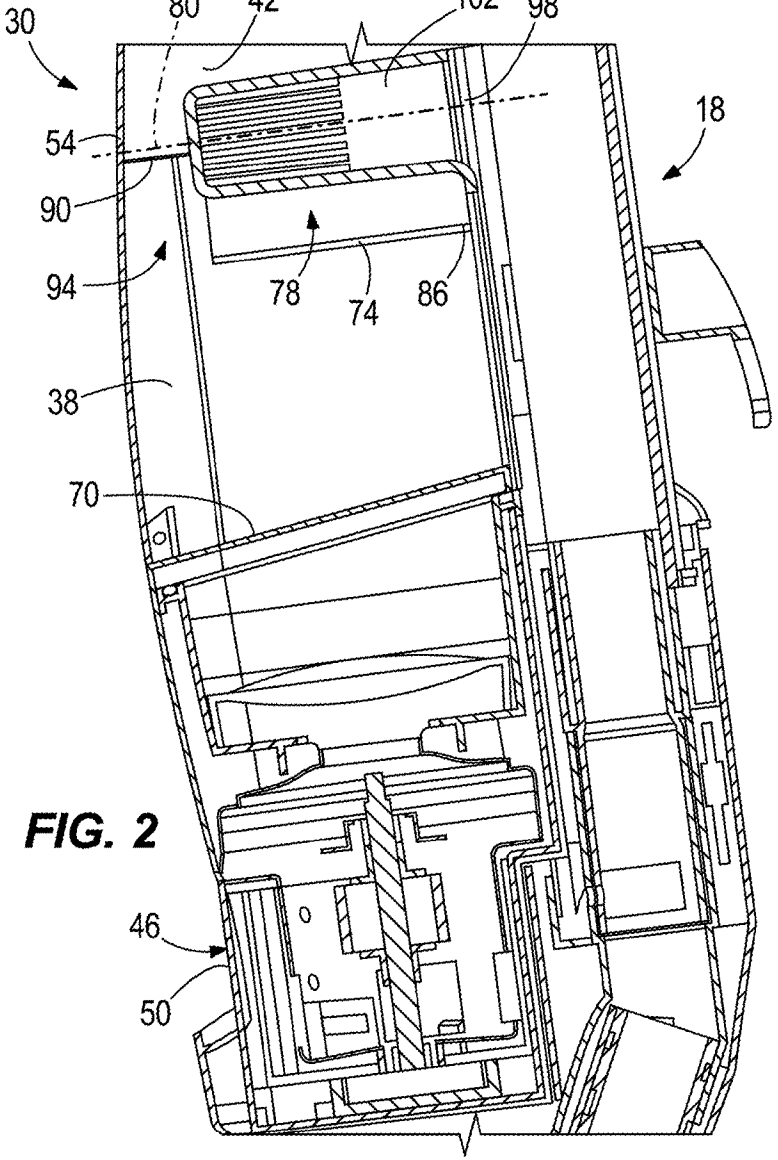
FIG. 2 is a partial cross-sectional view of the vacuum cleaner of FIG. 1.

With reference to FIG. 2, the vacuum cleaner 10 further includes a motor-fan assembly 46. The motor-fan assembly 46 is operable to generate an airflow from the inlet 26, through the separator 42, and to a clean air exhaust 48. In the illustrated embodiment, the motor-fan assembly 46 is positioned within a motor-fan assembly housing 50 below the canister assembly 30.

Figure 4:
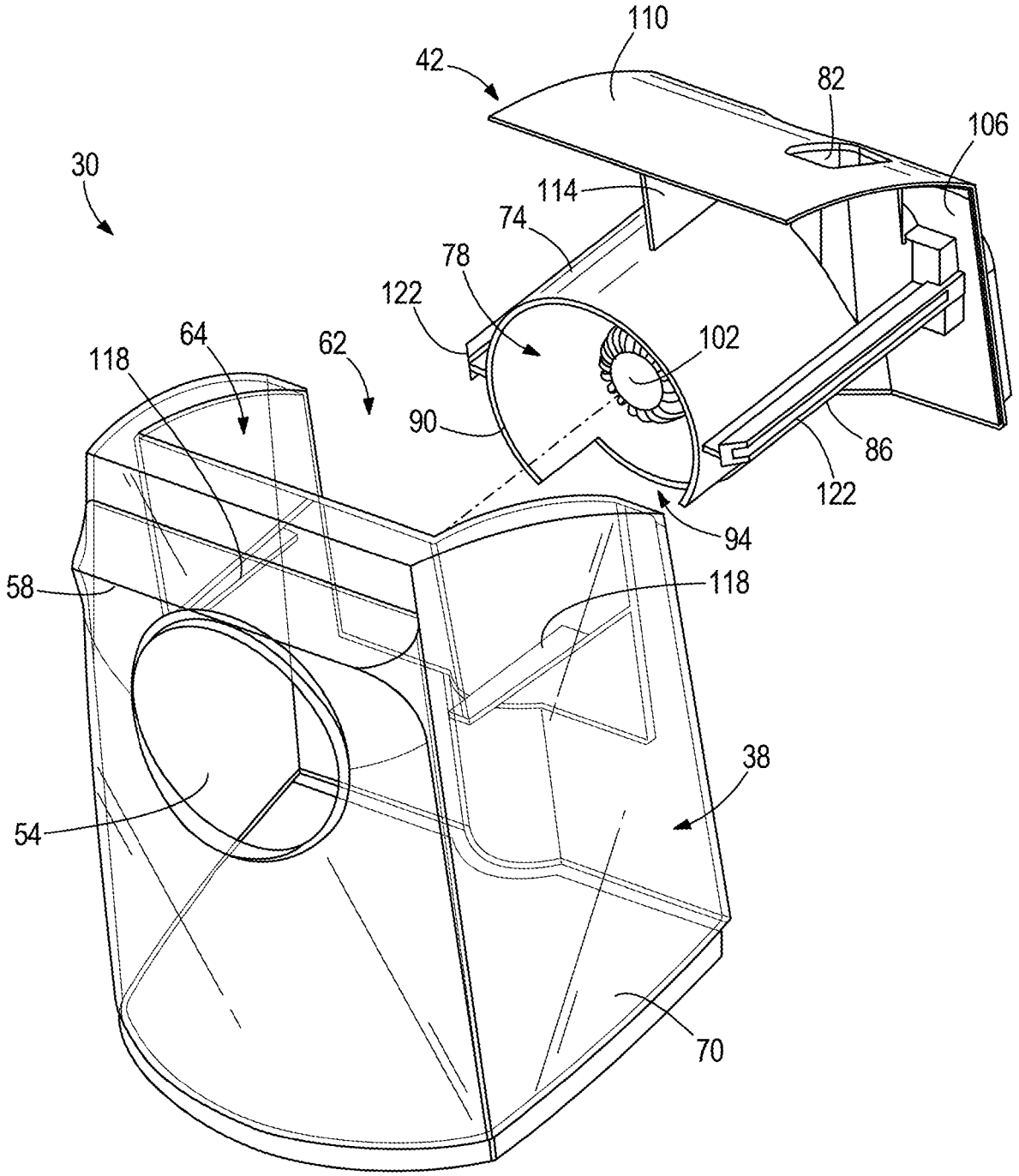
FIG. 4 is an exploded view of the canister assembly of FIG. 3.
Figure 5:
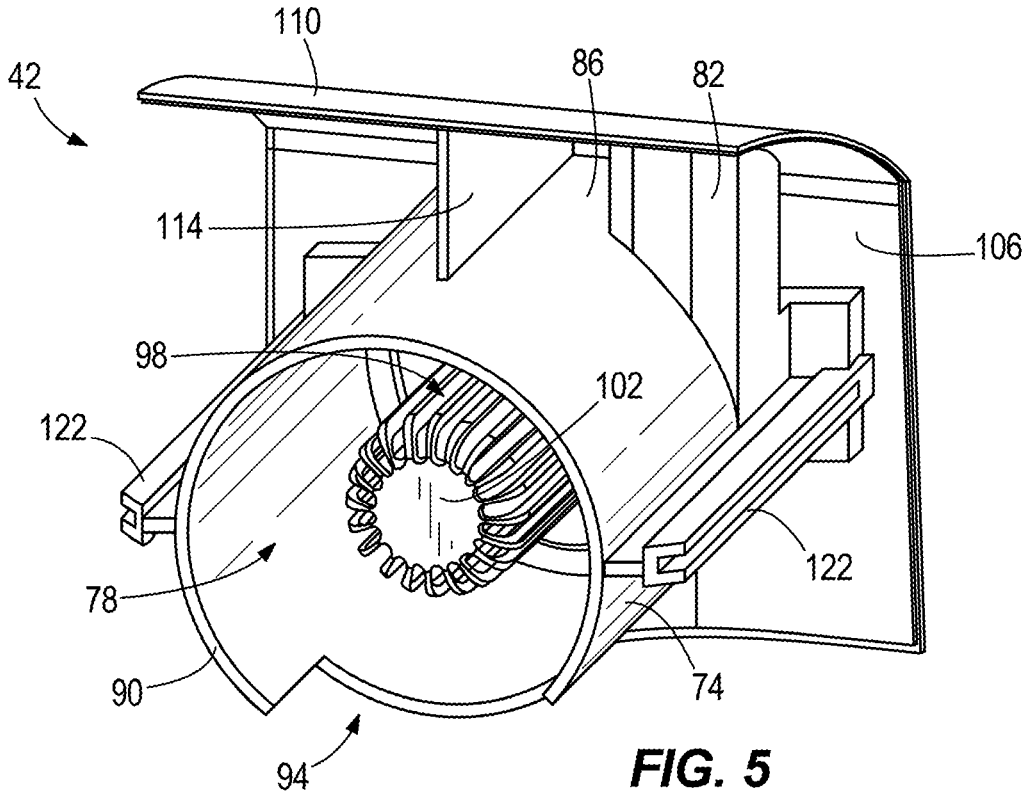
FIG. 5 is a perspective view of a separator of the canister assembly of FIG. 3.
Figure 6:
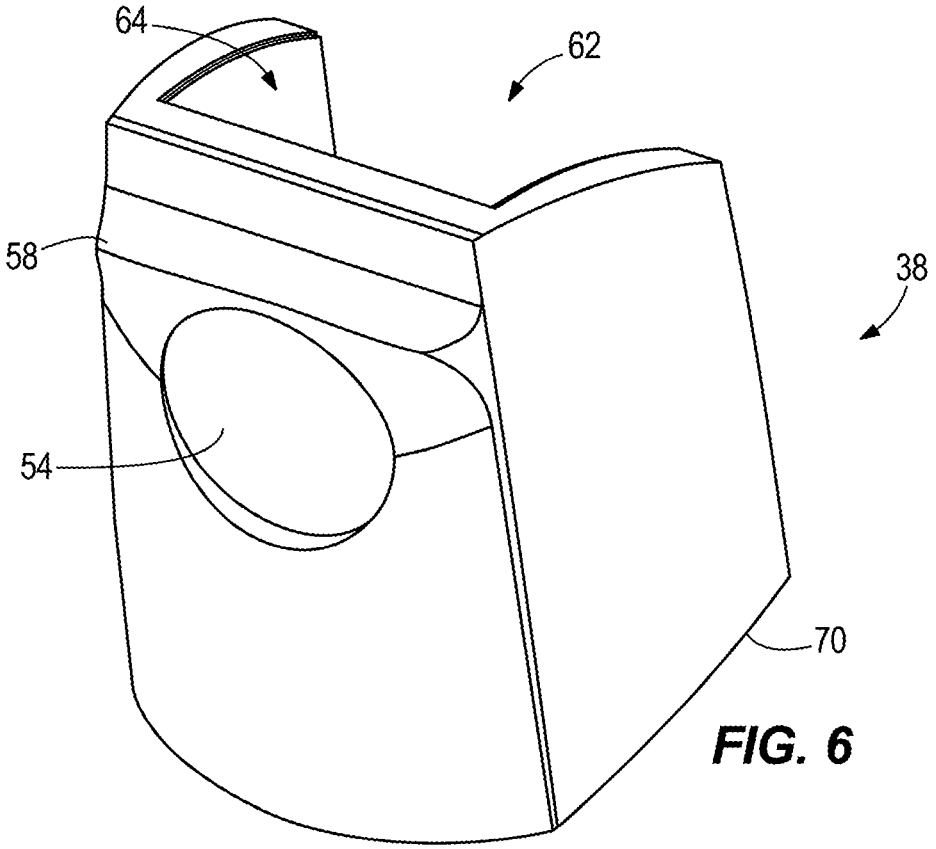
FIG. 6 is a perspective view of the dirt collection chamber of FIG. 3, shown non-transparently.
Figure 7:
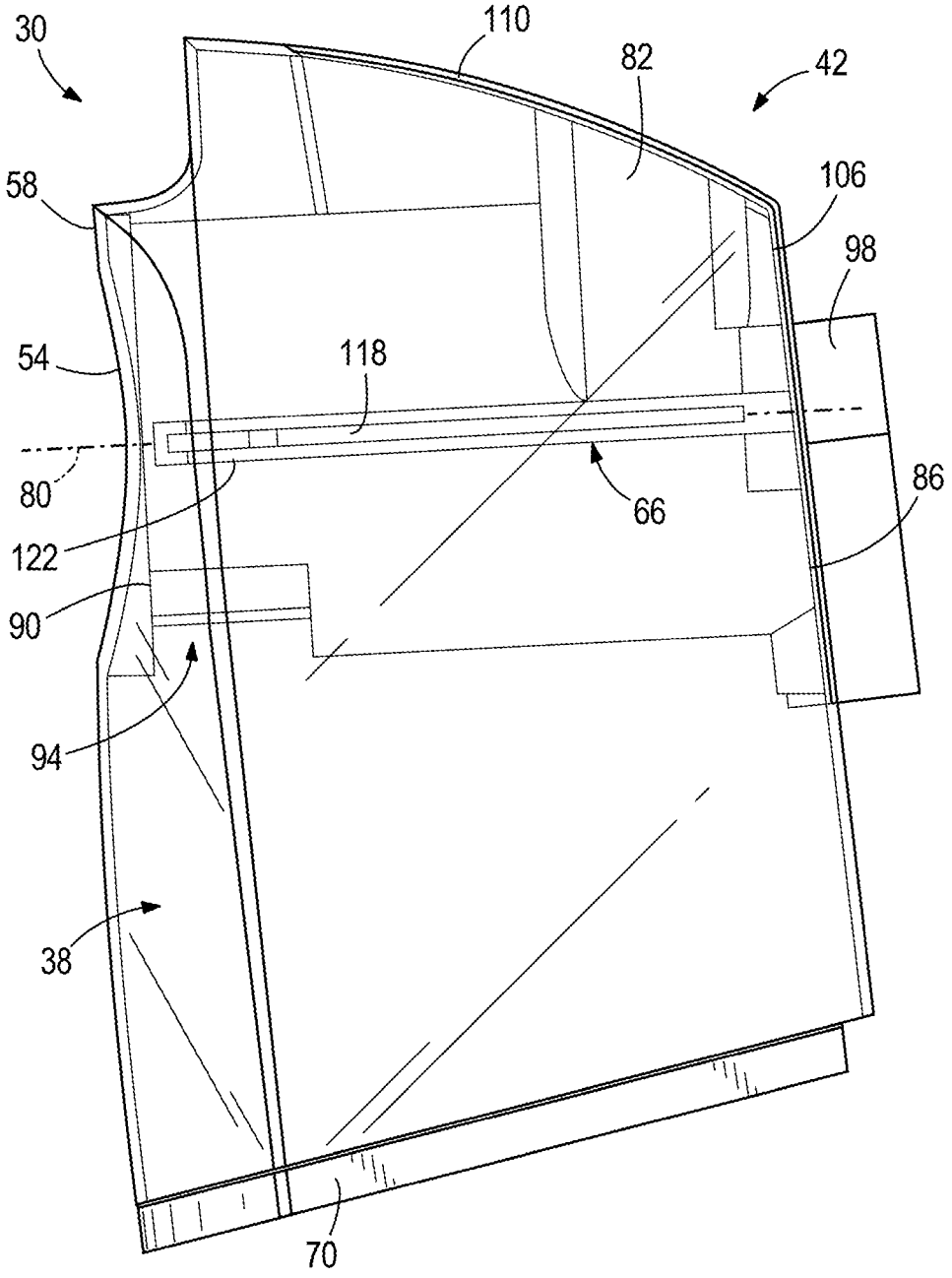
FIG. 7 is a side view of the canister assembly of FIG. 3, with the dirt collection chamber shown transparently.

With reference to FIGS. 3-7, the canister assembly 30 includes the dirt collection chamber 38 and the separator 42 removably coupled to the dirt collection chamber 38. With reference to FIGS. 6 and 7, the dirt collection chamber 38 includes a front wall 54 having a front ridge 58 that provides a gripping surface for the user to grasp the canister assembly.

In the illustrated embodiment and for ease of explanation, the "front" of the dirt collection chamber 38 is the forward facing surface relative to the direction of travel of the vacuum cleaner 10; however, it is contemplated that the front of the dirt collection chamber may be oriented in other directions relative to the forward direction of travel of the vacuum cleaner. The dirt collection chamber 38 also includes a rear opening 62 and a top opening 64 formed in the sidewalls of the dirt collection chamber 38, into which the separator 42 is received via a rail and groove arrangement 66, as described in further detail below. In some embodiments, the dirt collection chamber 38 may include a pivotably openable door 70. The pivotably openable door 70 in the illustrated embodiment is on the bottom of the dirt collection chamber 38 and extends at an angle as viewed from the side (FIG. 7). Also, in some embodiments, the canister assembly 30 may include a latch (not shown) to secure the canister assembly 30 to the upright section 18.

Figure 3:
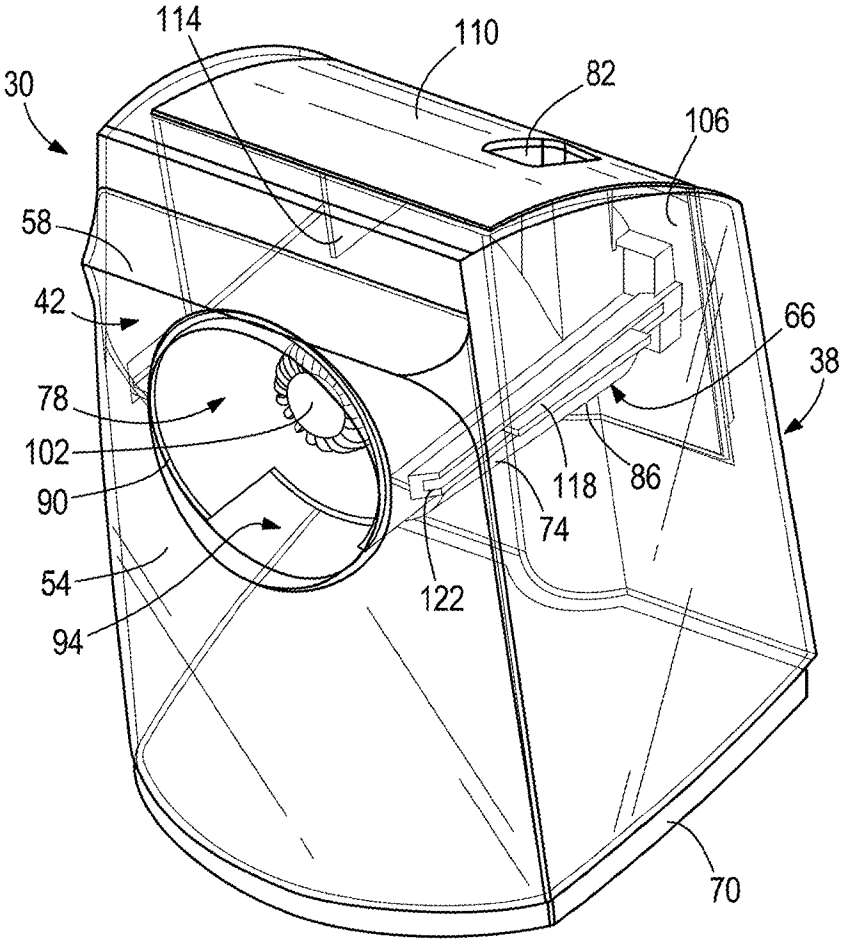
FIG. 3 is a perspective view of a canister assembly of the vacuum cleaner of FIG. 1, with a dirt collection chamber shown transparently.

Regarding FIGS. 3-5, in the illustrated embodiment, the separator 42 includes a cylindrical side wall 74 that defines a cyclonic chamber 78. In the illustrated embodiment, the cyclonic chamber 78 defines a longitudinal axis 80 with the cylindrical side wall 74 extending along the longitudinal axis 80. When the separator 42 is installed into the dirt collection chamber 38, the longitudinal axis 80 is oriented generally horizontal with the side wall 74 extending substantially horizontal with respect to the dirt collection chamber 38. In other words, when the upright section 18 is in the upright, stored position (FIG. 1), the cyclonic chamber 78 and longitudinal axis 80 extends generally horizontally. The cyclonic chamber 78 includes a tangential, dirty air inlet 82 in a first end 86 that receives dirt-laden air from the vacuum inlet 26. The dirty air enters the cyclonic chamber 78 and is spiraled against the cylindrical side wall 74 toward a second end 90 of the cyclonic chamber 78. A dirt outlet 94 is formed in the cylindrical side wall 74 and places the cyclonic chamber 78 in fluid communication with the dirt collection chamber 38. The dirt outlet 94 is cut out from the cylindrical side wall 74 and is oriented toward the dirt collection chamber 38 (i.e., in the illustrated embodiment, downwardly). Dirt entrained in the airflow is cyclonically separated from the airflow and flung out the dirt outlet 94. In the illustrated embodiment, the second end 90 of the cyclonic chamber 78 abuts the front wall 54 of the dirt collection chamber 38 closing the second end 90.

The clean air then flows through an air outlet 98 formed in the first end 86 of the cyclonic chamber 78. A baffle tube 102 positions the entry of the air outlet 98 adjacent the first end 86 to facilitate airflow out of the cyclonic chamber 78 into the air outlet 98 and to inhibit debris from entering the air outlet 98. The air may travel through one or more filters and then the motor-fan assembly 46 before being exhausted to atmosphere through the clean air exhaust 48.

In the illustrated embodiment, the separator 42 further includes a back cover 106 and a top cover 110. Optionally, a rib 114 may extend between the top cover 110 and the cylindrical side wall 74 of the cyclonic chamber 78 for structural support of the top cover 110. When the separator 42 is assembled in the dirt collection chamber 38, the top cover 110 closes the top opening 64 defining a portion of the dirt collection chamber 38 outer periphery. In other words, the top cover 110 forms part of the dirt collection chamber 38 boundary when the separator is installed. In the illustrated embodiment, the dirty air inlet 82 extends through the top cover 110. Similarly, the back cover 106 closes the rear opening 62 defining a portion of the dirt collection chamber 38 outer periphery when the separator 42 is assembled in the dirt collection chamber 38. In the illustrated embodiment, the air outlet 98 extends through the back cover 106. In an alternative embodiment not shown, the top cover 110 is integrally formed with the dirt collection chamber 38 omitting the top opening 64 shown in the illustrated embodiment such that the dirt collection chamber only includes the rear opening 62. In such an alternative, the separator includes the back cover configured to close the rear opening when the separator is assembled into the dirt collection chamber.

With reference to FIGS. 3-5, the rail and groove arrangement 66 of the illustrated embodiment includes two rails 118 in the dirt collection chamber 38 and two grooves 122 on the separator 42. Alternatively, any number of groove and rails may be used. For example, the rail and groove arrangement may include only one rail and corresponding groove, or may include three or more rails and corresponding grooves. In further alternative embodiments, the arrangement of the grooves and rails may be reversed so that the separator includes the grooves and the dirt collection chamber includes the rails. In the illustrated embodiment, the grooves 122 extend along the longitudinal length of the cyclonic chamber 78. More specifically, the grooves 122 are formed along the cylindrical side wall 74, and the grooves 122 are spaced approximately 180 degrees apart. In other words, the two grooves 122 of the illustrated embodiment are formed on opposite sides of the cyclonic chamber 78. In other embodiments, the grooves 122 may be spaced more or less than 180 degrees apart. The rail and groove arrangement 66 aligns the separator 42 for generally horizontal insertion into the dirt collection chamber 38. The separator 42 is received within the rear opening 62 of the dirt collection chamber 38 with the grooves 122 receiving the corresponding rails 118. In alternative embodiments, the opening may be formed in a front portion of the dirt collection chamber with the separator sliding into the dirt collection chamber from the front, or the opening may be formed in any one of the dirt collection chamber sidewalls. In further alternative embodiments, an end of the cyclonic chamber may abut a rear wall of the dirt collection chamber. The separator 42 being slidably received within the dirt collection chamber 38 may be referred to as a "drawer design."

In operation, the separator 42 is installed into the dirt collection chamber 38 by aligning the grooves 122 on the separator 42 with the rails 118 of the dirt collection chamber 38. With the separator 42 installed in the dirt collection chamber 38, the canister assembly 30 is coupled to the upper section 18. With the canister assembly 30 positioned and locked on the upright section 18, the vacuum cleaner 10 is ready for cleaning surfaces.

In order to remove the collected dirt from the vacuum cleaner 10, the canister assembly 30 is removed from the upright section 18 and the door 70 is opened to allow the dirt collection chamber 38 to be emptied. In addition, the separator 42 can be removed from the dirt collection chamber 38 by sliding the separator 42 out of the opening 62 in order to more easily clean out and service the cyclonic chamber 78.

Figure 8:
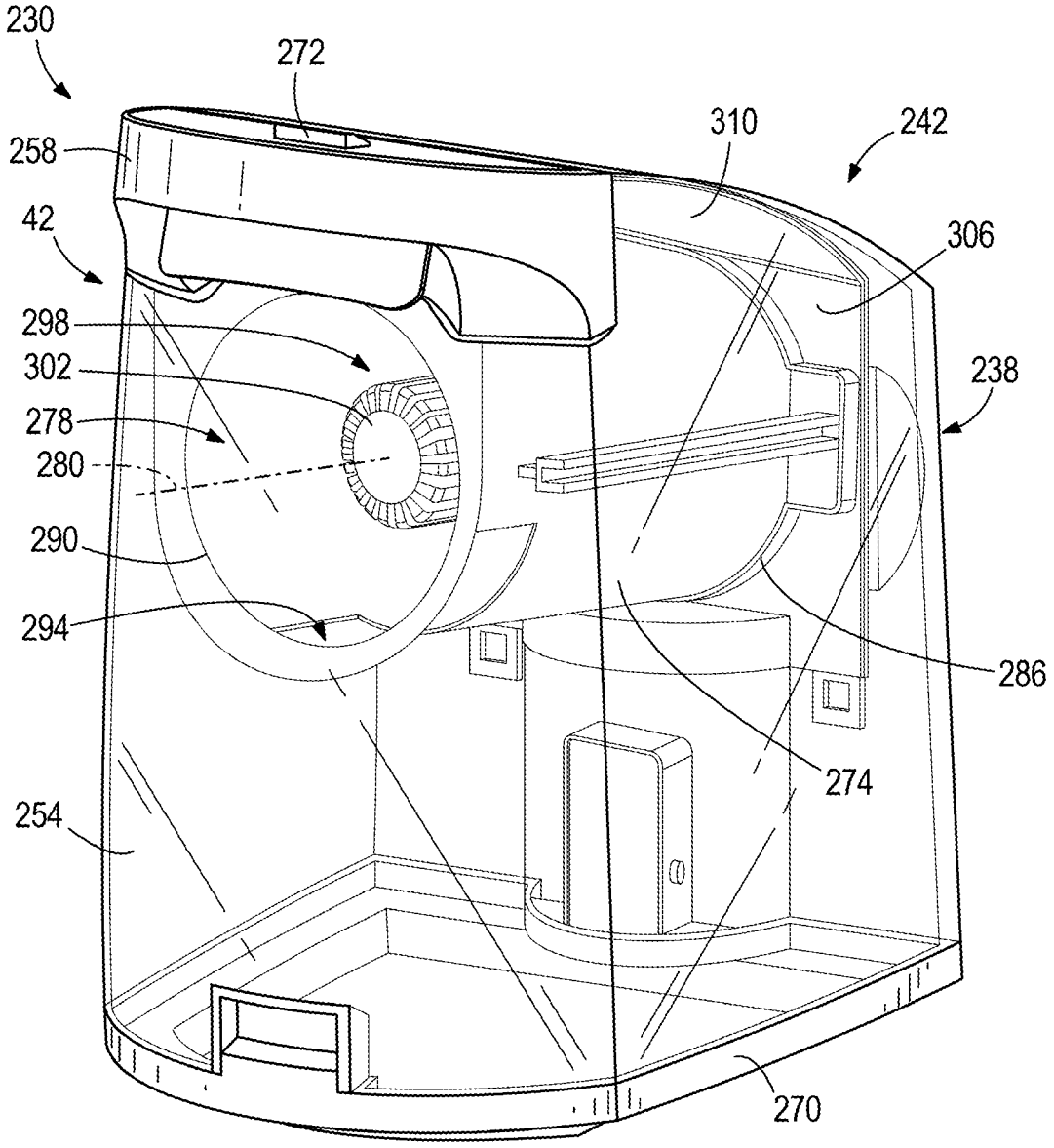
FIG. 8 is a perspective view of a canister assembly according to another embodiment of the invention with a dirt collection chamber shown transparently.
Figure 9:
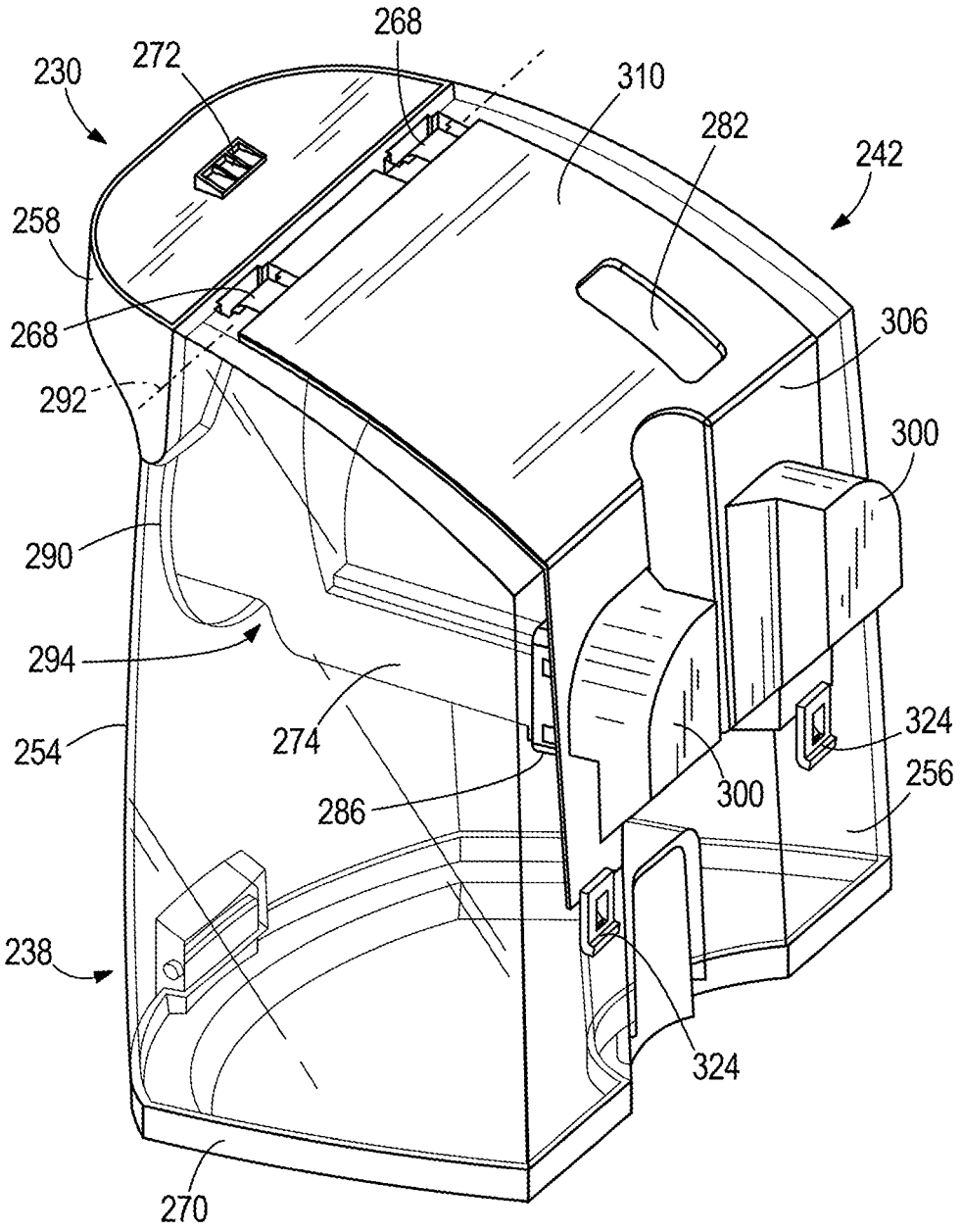
FIG. 9 is a rear perspective view of the canister assembly of FIG. 8 with a separator in a first, closed configuration.
Figure 10:
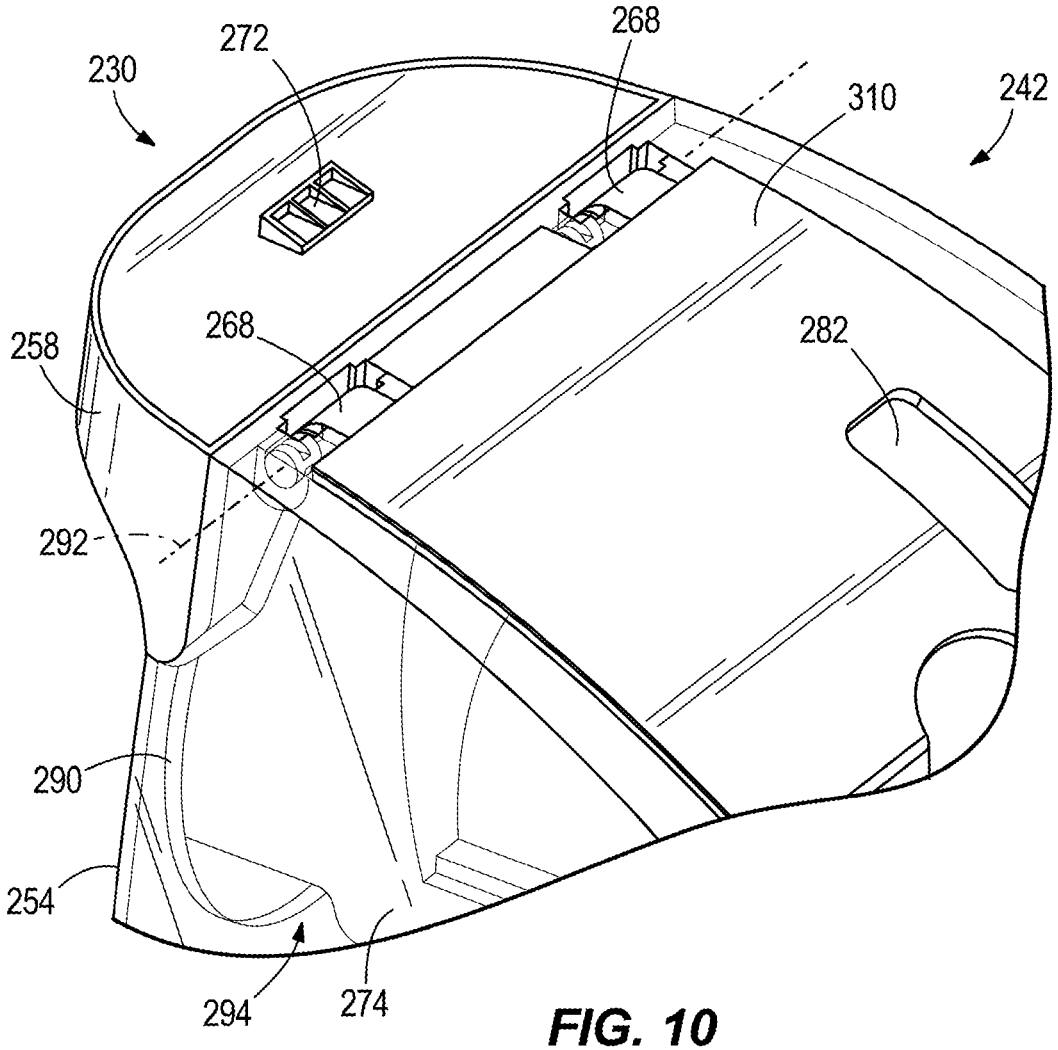
FIG. 10 is an enlarged partial rear perspective view of the canister assembly of FIG. 9.
Figure 11:
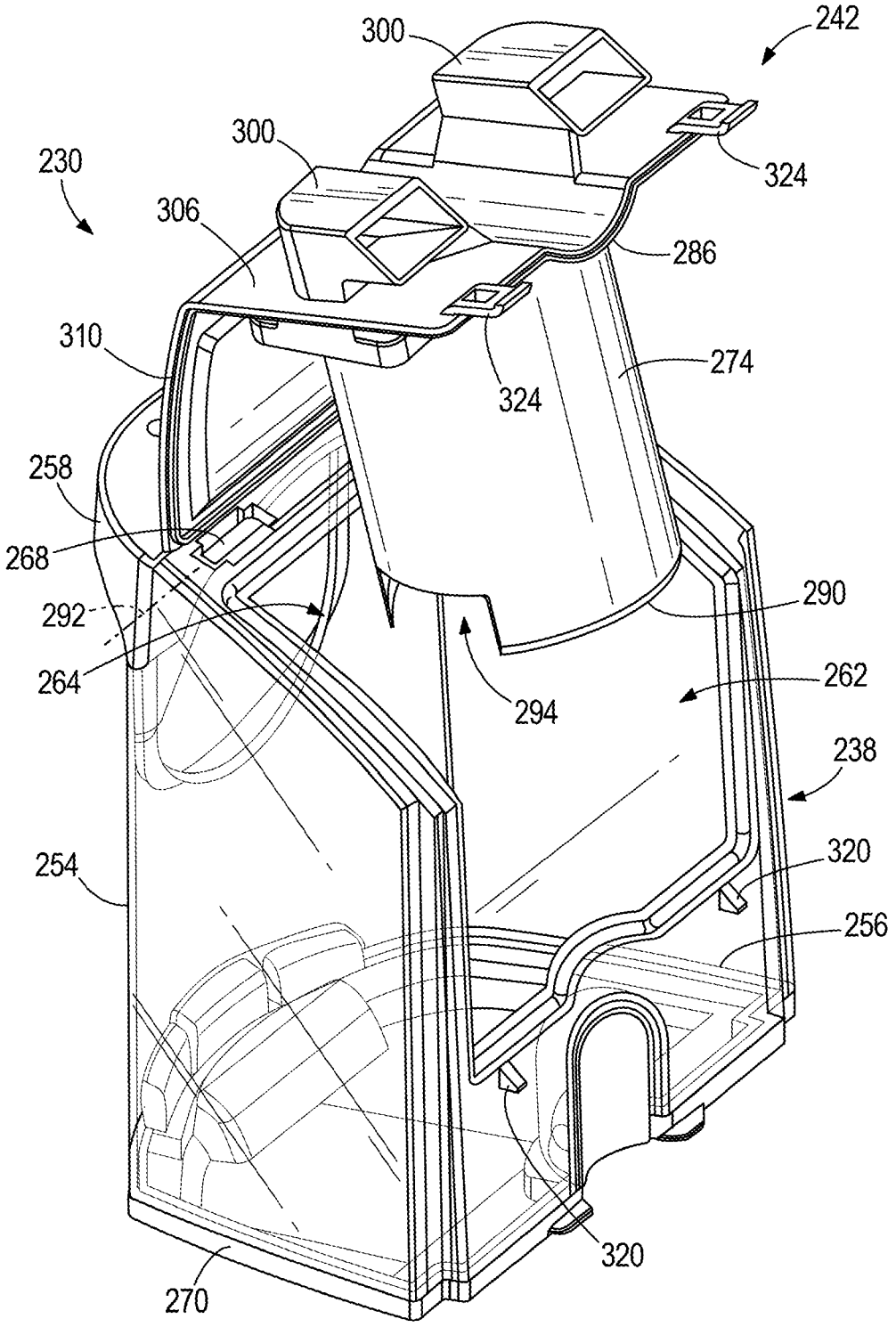
FIG. 11 is a rear perspective view of the canister assembly of FIG. 8 with the separator in a second, open configuration.
Figure 12:
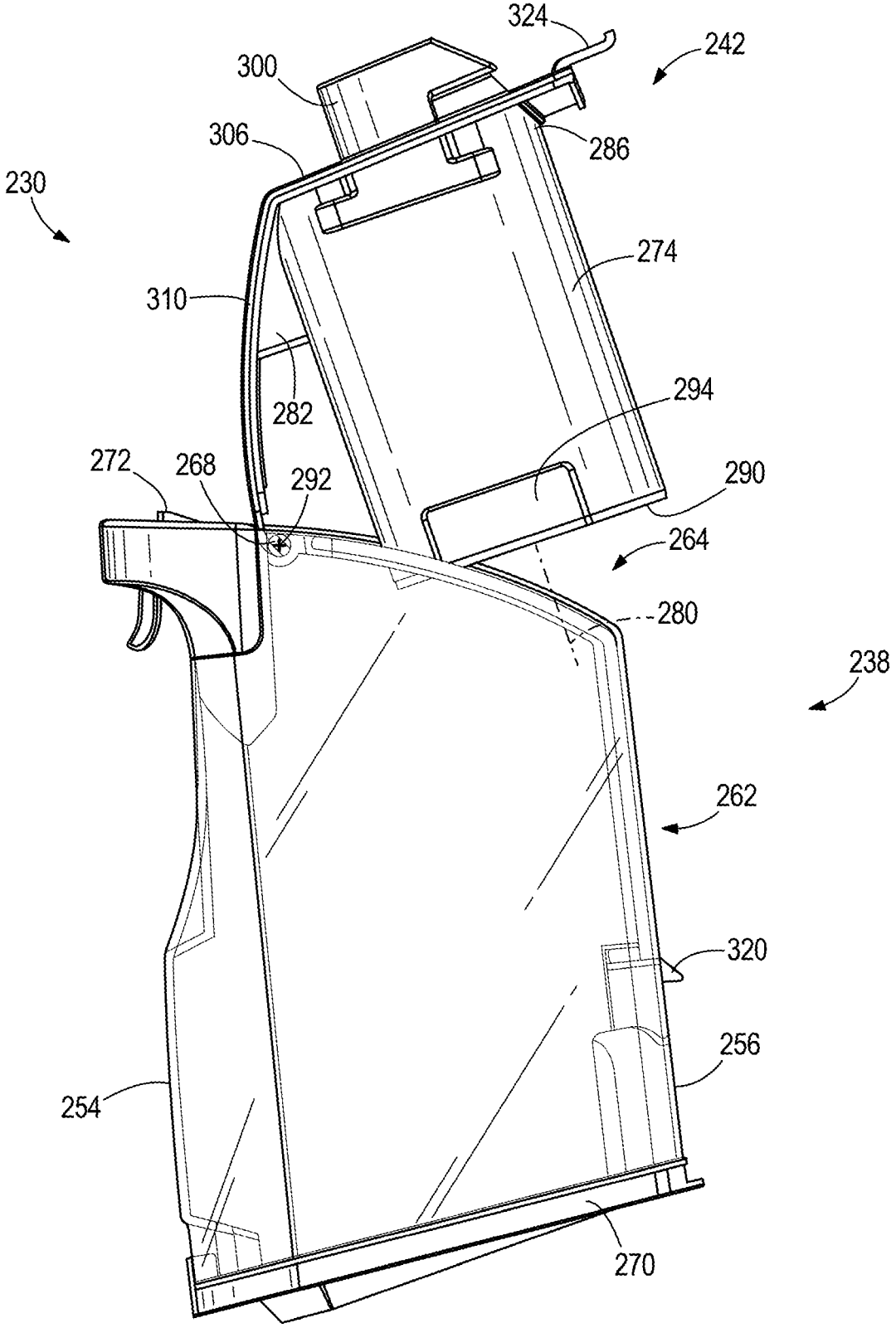
FIG. 12 is a side view of the canister assembly of FIG. 11.

With reference to FIGS. 8-13, a canister assembly 230 according to an alternative embodiment of the invention is illustrated. The canister assembly 230 includes a dirt collection chamber 238 and a separator 242 pivotably coupled to the dirt collection chamber 238. With reference to FIGS. 8, 9, and 11 the dirt collection chamber 238 includes a front wall 254 having a front ridge 258 that provides a gripping surface for the user to grasp the canister assembly 230. As before, it is contemplated that the "front" of the dirt collection chamber 238 may be oriented in other directions relative to the forward direction of travel of the vacuum cleaner. The dirt collection chamber 238 also includes a rear opening 262 and a top opening 264 formed in the sidewalls of the dirt collection chamber 238 (FIG. 11), into which the separator 242 is received via a pivoting hinge 268, as described in further detail below. The dirt collection chamber 238 also includes a pivotably openable door 270. The pivotably openable door 270 in the illustrated embodiment is on the bottom of the dirt collection chamber 238 and extends at an angle as viewed from the side (FIG. 12). Also, the canister assembly 230 includes a latch 272 to secure the canister assembly 230 to the upright section 18.

Regarding FIGS. 8 and 11, in the illustrated embodiment, the separator 242 includes a cylindrical side wall 274 that defines a cyclonic chamber 278. In the illustrated embodiment, the cyclonic chamber 278 defines a longitudinal axis 280 with the cylindrical side wall 274 extending along the longitudinal axis 280. When the separator 242 is installed into the dirt collection chamber 238, the longitudinal axis 280 is oriented generally horizontal with the side wall 274 extending substantially horizontal with respect to the dirt collection chamber 238. In other words, when the upright section 18 is in the upright, stored position (FIG. 1), the cyclonic chamber 278 and longitudinal axis 280 extends generally horizontally. The cyclonic chamber 278 includes a tangential, dirty air inlet 282 in a first end 286 that receives dirt-laden air from the vacuum inlet 26. The dirty air enters the cyclonic chamber 278 and is spiraled against the cylindrical side wall 274 toward a second end 290 of the cyclonic chamber 278. A dirt outlet 294 is formed in the cylindrical side wall 274 and places the cyclonic chamber 278 in fluid communication with the dirt collection chamber 238. The dirt outlet 294 is formed in the cylindrical side wall 274 and is oriented toward the dirt collection chamber 238 (i.e., in the illustrated embodiment, downwardly). Dirt entrained in the airflow is cyclonically separated from the airflow and flung out the dirt outlet 294. In the illustrated embodiment, the second end 290 of the cyclonic chamber 278 abuts the front wall 254 of the dirt collection chamber 238 closing the second end 290. The second end 290 can include a seal that compresses between the second end 290 and the front wall 254 when the separator 242 is installed into the dirt collection chamber 238.

The clean air then flows through an air outlet 298 formed in the first end 286 of the cyclonic chamber 278. A baffle tube 302 positions the entry of the air outlet 298 adjacent the first end 286 to facilitate airflow out of the cyclonic chamber 278 into the air outlet 298 and to inhibit debris from entering the air outlet 298. The air may travel through one or more filters and then the motor-fan assembly 46 before being exhausted to atmosphere through the clean air exhaust 48.

In the illustrated embodiment, the separator 242 further includes a back cover 306 and a top cover 310. When the separator 242 is assembled in the dirt collection chamber 238, the top cover 310 may close the top opening 264 defining a portion of the dirt collection chamber 238 outer periphery. In other words, the top cover 310 may form part of the dirt collection chamber 238 boundary when the separator 242 is installed. In alternative embodiments, additional walls or baffles may be provided along the separator 242 such that a dirt collection chamber boundary is adjacent to and/or formed in part by the separator when the separator is installed. In the illustrated embodiment, the dirty air inlet 282 extends through the top cover 310. Similarly, the back cover 3106 closes the rear opening 262 defining a portion of the dirt collection chamber 238 outer periphery when the separator 242 is assembled in the dirt collection chamber 238. In the illustrated embodiment, the air outlet 298 includes two air exit ducts 300 positioned downstream of the baffle tube 302. The air outlet ducts 300 extend outwardly from the back cover 306.

Figure 13:
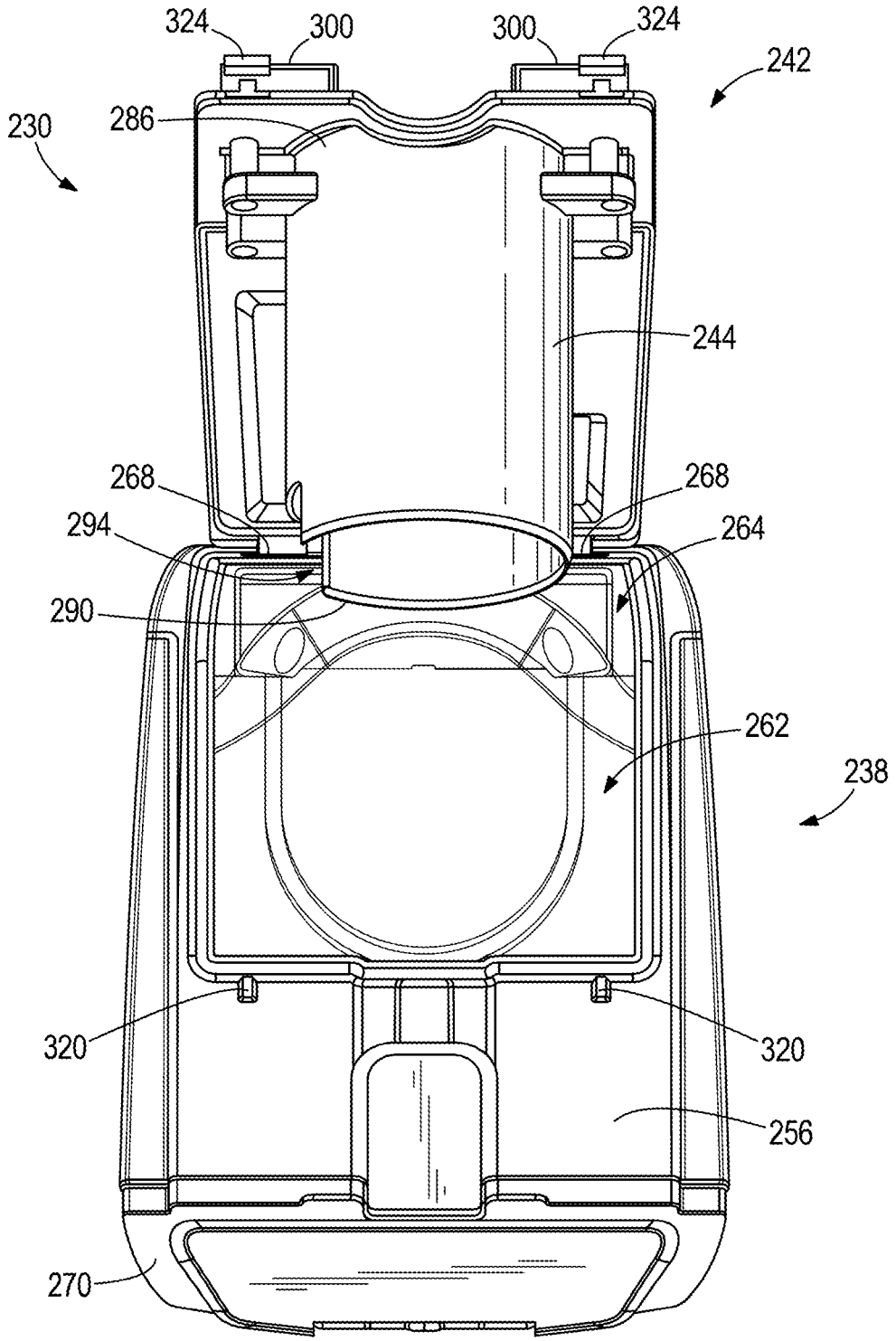
FIG. 13 is a rear view of the canister assembly of FIG. 11.

With reference to FIGS. 9 and 10, the illustrated embodiment includes two hinges 268. Alternatively, any number of hinges may be used. In the illustrated embodiment, the hinges 268 are provided on the top cover 310. Alternatively, hinges may be provided on any portion of the separator 242. The hinges 268 allow the separator 242 to pivot about an axis 292 between a first, closed position (FIG. 9) and a second, opened position (FIG. 11). In the first position, the longitudinal axis 280 of the separator 242 is oriented generally horizontally. In the second, opened position, the cyclonic chamber 278 is removed from the dirt collection chamber 238. In addition, when in the second position, the longitudinal axis 280 of the cyclonic chamber 278 is generally vertical (FIG. 12). When the separator 242 is in the second position, any dirt or debris that may be in the cyclonic chamber 278 may be removed through the open second end 290 of the cyclonic chamber 278. With reference to FIGS. 11-13, the dirt collection chamber 238 includes a back wall 256 having locking projections 320 formed thereon. The separator 242 includes corresponding locking members 324 on the back cover 306 that engage the locking projections 320 to secure the separator 242 in the first position.

In operation, the separator 242 is installed into the dirt collection chamber 238 by pivoting the separator 242 into the dirt collection chamber 238. With the separator 242 installed in the dirt collection chamber 238, the canister assembly 230 is coupled to the upper section 18. With the canister assembly 230 positioned and locked on the upright section 18, the vacuum cleaner 10 is ready for cleaning surfaces.

In order to remove the collected dirt from the vacuum cleaner 10, the canister assembly 230 is removed from the upright section 18 and the door 270 is opened to allow the dirt collection chamber 238 to be emptied. In addition, the separator 242 can be removed from the dirt collection chamber 238 by pivoting the separator 242 out of the opening 262 in order to more easily clean out and service the cyclonic chamber 278.

Although the invention has been described in detail with reference to certain preferred embodiments, variations and modifications exist within the scope and spirit of one or more independent aspects of the invention as described.

What is claimed is:

1. A vacuum cleaner operable to separate debris from an airflow, the vacuum cleaner comprising:

a separator defining a cyclonic chamber having a dirty air inlet, a dirt outlet, and an air outlet; and a dirt collection chamber in fluid communication with the dirt outlet of the cyclonic chamber, the dirt collection chamber further including a sidewall having an opening, wherein the separator is pivotably coupled to the dirt collection chamber, the separator received within the dirt collection chamber by pivoting the separator into the opening.

2. The vacuum cleaner of claim 1, wherein the separator further includes a hinge pivotably coupling the separator to the dirt collection chamber.

3. The vacuum cleaner of claim 1, wherein the separator is movable between a first position in which a longitudinal axis of the cyclonic chamber is oriented generally horizontally, and a second position in which the cyclonic chamber is removed from the dirt collection chamber.

4. The vacuum cleaner of claim 3, wherein in the second position, the longitudinal axis of the cyclonic chamber is generally vertical.

5. The vacuum cleaner of claim 3, wherein an end of the cyclonic chamber is open, and dirt within the cyclonic chamber is removed through the open end of the cyclonic chamber when the separator is in the second position.

6. The vacuum cleaner of claim 1, wherein the dirty air inlet is formed in a first end of the cyclonic chamber and the dirt outlet is formed in a second end of the cyclonic chamber.

7. The vacuum cleaner of claim 6, wherein the air outlet is formed in the first end of the cyclonic chamber.

8. The vacuum cleaner of claim 6, wherein the second end of the cyclonic chamber abuts a front wall of the dirt collection chamber.

9. The vacuum cleaner of claim 1, wherein the separator further includes a top cover that, when assembled in the dirt collection chamber, defines an outer periphery of the dirt collection chamber.

10. The vacuum cleaner of claim 9, wherein the separator further includes a back cover that, when assembled in the dirt collection chamber, defines an outer periphery of the dirt collection chamber.

11. The vacuum cleaner of claim 10, wherein the air outlet includes two air exit ducts.

12. The vacuum cleaner of claim 11, wherein the air exit ducts extend outwardly from the back cover.

13. The vacuum cleaner of claim 10, wherein projections are formed on a back surface of the dirt collection chamber, and the back cover of the separator includes locking members that engage the projections to secure the separator in the first position.

14. The vacuum cleaner of claim 9, wherein the dirty air inlet extends through the top cover.

15. The vacuum cleaner of claim 9, wherein a hinge pivotably coupling the separator and the dirt collection chamber is provided on the top cover.

16. The vacuum cleaner of claim 1, wherein a baffle tube is coupled to the air outlet.

17. The vacuum cleaner of claim 1, wherein the separator is a first stage separator.

18. The vacuum cleaner of claim 17, wherein the first stage separator includes a cylindrical sidewall that defines the cyclonic chamber, wherein the cylindrical sidewall is pivotally couple to the dirt collection chamber, the cylindrical sidewall received within the dirt collection chamber by pivoting the separator into the opening.

19. The vacuum cleaner of claim 18, wherein the dirt collection chamber includes a bottom wall and a sidewall that extends upwardly from the bottom wall the sidewall of the dirt collection chamber having at least a portion of the opening.

20. A vacuum cleaner operable to separate debris from an airflow, the vacuum cleaner comprising:

a first stage separator having a cylindrical outer sidewall defining a cyclonic chamber, the cyclonic chamber having a dirty air inlet, a dirt outlet, and an air outlet; and a dirt collection chamber in fluid communication with the dirt outlet of the cyclonic chamber, the dirt collection chamber further including a bottom wall and a sidewall that extends upwardly from the bottom wall, the sidewall having an opening, wherein the first stage separator, including the cylindrical outer sidewall, is removably and pivotally received within the dirt collection chamber by pivoting the separator into the opening of the sidewall, wherein the first stage separator, including the cylindrical outer wall, is removable from within the dirt collection chamber.

* * * * *